US007163036B2

(12) United States Patent
Hodgson et al.

(10) Patent No.: US 7,163,036 B2
(45) Date of Patent: Jan. 16, 2007

(54) METHOD OF SUPPLYING FLUORINE

(75) Inventors: Graham Hodgson, Poulton-le-Fylde (GB); Andrew William Shuttleworth, Hoboken, NJ (US)

(73) Assignee: The BOC Group plc, Windlesham (GB)

( * ) Notice: Subject to any disclaimer, the term of this patent is extended or adjusted under 35 U.S.C. 154(b) by 195 days.

(21) Appl. No.: 11/019,842

(22) Filed: Dec. 22, 2004

(65) Prior Publication Data

US 2006/0130929 A1 Jun. 22, 2006

(51) Int. Cl.
*B65B 1/04* (2006.01)

(52) U.S. Cl. ..... 141/231; 141/100; 141/98

(58) Field of Classification Search ..... 141/2, 141/1, 189, 104, 100, 67, 65, 286, 231
See application file for complete search history.

(56) References Cited

U.S. PATENT DOCUMENTS

| | | | | |
|---|---|---|---|---|
| 2,075,408 A | | 3/1937 | Sholes | |
| 5,137,047 A | * | 8/1992 | George | 137/240 |
| 5,562,132 A | | 10/1996 | Siegele et al. | |
| 5,569,151 A | * | 10/1996 | Karwacki et al. | 588/249 |
| 6,260,588 B1 | | 7/2001 | Noah et al. | |
| 6,296,025 B1 | | 10/2001 | Gregg et al. | |
| 6,955,801 B1 | * | 10/2005 | Torisu et al. | 423/500 |

FOREIGN PATENT DOCUMENTS

| | | |
|---|---|---|
| EP | 0 255 003 B1 | 2/1988 |
| EP | 1 067 327 A2 | 1/2001 |
| EP | 1 114 790 A2 | 7/2001 |
| WO | WO 99/02251 | 1/1999 |
| WO | WO 00/00767 | 1/2000 |

OTHER PUBLICATIONS

PCT Notification of Transmittal of the International Search Report and the Written Opinion of the International Searching Authority, or the Declaration of International Application No. PCT/GB2005/004410; Date of mailing: Apr. 21, 2006.

PCT International Search Report of International Application No. PCT/GB2005/004410; Date of mailing of the International Search Report: Apr. 21, 2006.

PCT Written Opinion of the International Searching Authority of International Application No. PCT/GB2005/004410; Date of mailing: Apr. 21, 2006.

* cited by examiner

*Primary Examiner*—Steven O. Douglas
(74) *Attorney, Agent, or Firm*—Ira Lee Zebrak

(57) ABSTRACT

In a method of delivering high purity fluorine to a processing system, an on-site fluorine generator supplies high purity fluorine to a fixed storage tank, from which the high purity fluorine is supplied to the processing system. To provide a back up to the fluorine generator, high purity fluorine is also provided in a transportable gas storage vessel, for example, a multi-cylinder pack at a relatively low pressure, typically less than 35 psig. The transportable storage vessel is selectively connected to the fixed storage tank as required to enable the amount of fluorine within the storage tank to be maintained at a desired level.

49 Claims, 1 Drawing Sheet

METHOD OF SUPPLYING FLUORINE

FIELD OF THE INVENTION

This invention relates to a method of, and apparatus for, supplying fluorine to a processing system.

BACKGROUND OF THE INVENTION

A primary step in the fabrication of semiconductor devices is the formation of a thin film on a semiconductor substrate by chemical reaction of vapour precursors. One known technique for depositing a thin film on a substrate is chemical vapour deposition (CVD). In this technique, gases are supplied to a process chamber housing the substrate and react to form a thin film over the surface of the substrate. However, deposition is not restricted to the surface of the substrate, and this can result, for example, in the clogging of gas nozzles and the clouding of chamber windows. In addition, particulates may be formed, which can fall on the substrate and cause a defect in the deposited thin film, or interfere with the mechanical operation of the deposition system. As a result of this, the inside surface of the process chamber is regularly cleaned to remove the unwanted deposition material from the chamber.

One method of cleaning the chamber is to supply molecular fluorine ($F_2$) to react with the unwanted deposition material. Fluorine is either supplied at a high purity (at least 99% fluorine) in single, high-pressure cylinder at 200 or 400 psig, or supplied diluted with nitrogen in the ratio of 20% $F_2$ to 80% $N_2$ in single, high-pressure cylinder at up to 2000 psig. At such high pressures, fluorine becomes very reactive and thus poses a serious safety hazard. While on-site fluorine generators are available for supplying high purity fluorine directly to the processing system, multiple generators are required to maintain fluorine output in the event of a failure of one of the generators, which significantly increases costs.

It is an aim of at least the preferred embodiments of the present invention to provide a low cost, relatively safe method of delivering high purity fluorine.

SUMMARY OF THE INVENTION

In a first aspect, the present invention provides a method of delivering high purity fluorine to a processing system, the method comprising the steps of generating high purity fluorine using a fluorine generator located proximate the processing system, transferring fluorine from the fluorine generator to a fixed storage tank, providing a transportable gas storage vessel containing high purity fluorine at a pressure below 35 psig, selectively transferring fluorine from the transportable gas storage vessel to the fixed storage tank, and delivering fluorine to the processing system from the fixed storage tank.

A transportable gas storage vessel is thus provided as a back up to the fluorine generator in the event that the fluorine generator fails or is otherwise unable to supply fluorine to the fixed storage tank. This can significantly reduce costs in comparison to providing a second fluorine generator as a back up. Following exhaustion of the storage vessel, the exhausted storage vessel can be readily replaced by a fresh storage vessel. Due to the relatively low pressure at which fluorine is stored in the transportable gas storage vessel (i.e. below 35 psig, preferably below 25 psig) in comparison to the pressure at which fluorine is traditionally stored in gas cylinders (up to 2000 psig), the fluorine reactivity is significantly reduced, thereby greatly improving the safety of the handling (transportation, replacement, etc.) of storage vessels. This can also enable the storage vessels to be safely stockpiled in readiness for future use.

The storage vessel may comprise any suitable transportable vessel for storing high purity fluorine at a relatively low pressure. For example, the transportable storage vessel may comprise a singe transportable bulk container, or plurality of gas cylinders, for example, between six and sixteen cylinders, containing high purity fluorine, the gas cylinders preferably being connected to a common manifold from which fluorine is transferred to the fixed storage tank. The amount of fluorine stored in such a storage vessel can therefore be much greater than that stored in a 20% $F_2$/80% $N_2$ gas cylinder, thereby reducing the frequency at which the fluorine source needs to be replaced and further improving safety. For example, while a 49 liter gas cylinder contains around 1.4 kg of $F_2$ within a 20% $F_2$/80% $N_2$ gas mixture at 400 psig, a 735 liter transportable gas storage vessel, comprising fifteen 49 liter gas cylinders, can contain around 3.2 kg of $F_2$ within a high purity $F_2$ gas at 25 psig.

Fluorine may be stored in the fixed storage tank at a pressure in the range from 5 to 25 psig, preferably around 20 psig. A compressor may be provided for transferring fluorine from the transportable gas storage vessel to the fixed storage tank. The use of a compressor is particularly advantageous when the fluorine pressure required at the chamber of the processing system is greater than the fluorine pressure that could be provided from the storage vessel alone, either due to the pressure drop between the storage vessel and the chamber and/or the pressure at which fluorine is stored in the storage vessel. The use of a compressor can thus provide a necessary boost to the fluorine pressure between the storage vessel and the chamber.

The fixed storage tank preferably has a volume in the range from 500 to 1500 liters, preferably around 1000 liters. The purity of the fluorine is at least 99% fluorine, more preferably at least 99.5% fluorine, Due to the presence of an on-site fluorine generator, an exhausted storage vessel may be re-filled with gas generated by the fluorine generator, rather than being returned to a remote site for re-filling and subsequent transport back to the processing system. This can provide rapid back up of the fluorine generator following exhaustion of the storage vessel, as well as providing further cost reductions and improved safety. Therefore, in a second aspect, the present invention provides a method of delivering high purity fluorine to a processing system, the method comprising the steps of generating high purity fluorine using a fluorine generator located proximate the processing system, transferring fluorine from the fluorine generator to a fixed storage tank, filling a transportable gas storage vessel with fluorine generated by the fluorine generator to a pressure below 35 psig, selectively transferring fluorine from the transportable gas storage vessel to the fixed storage tank, and delivering fluorine to the processing system from the fixed storage tank.

Where the transportable gas storage vessels are both filled remotely and returned to the remote site for re-filling, it may, of course, be possible to deliver high purity fluorine from these storage vessels in the absence of an on-site fluorine generator. Such a second source of fluorine may be removed altogether, or may be replaced by another transportable gas storage vessel for providing a back up source of high purity fluorine. Thus, in a third aspect the present invention provides a method of delivering high purity fluorine to a processing system, the method comprising the steps of transporting to the processing system a transportable gas storage vessel containing high purity fluorine at a pressure below 35 psig, transferring fluorine from the transportable gas storage vessel to a fixed storage tank, and delivering fluorine to the processing system from the fixed storage tank.

Features described above in relation to method aspects of the invention are equally applicable to apparatus aspects, and vice versa. Therefore, in a fourth aspect the present invention provides apparatus for delivering high purity fluorine to a processing system, the apparatus comprising a fluorine generator located proximate the processing system for generating high purity fluorine, a fixed storage tank, means from transferring fluorine from the fluorine generator to the fixed storage tank, a transportable gas storage vessel containing high purity fluorine at a pressure below 35 psig, means for selectively transferring fluorine from the storage vessel to the fixed storage tank, and means for delivering fluorine to the processing system from the fixed storage tank.

Furthermore, in a fifth aspect the present invention provides apparatus for delivering high purity fluorine to a processing system, the apparatus comprising a transportable gas storage vessel containing high purity fluorine at a pressure below 35 psig, a fixed storage tank, means for transferring fluorine from the storage vessel to the fixed storage tank, and means for delivering fluorine to the processing system from the fixed storage tank.

BRIEF DESCRIPTION OF THE DRAWINGS

Preferred features of the present invention will now be described with reference to the accompanying drawings, in which.

DETAILED DESCRIPTION OF THE INVENTION

Figure 1:
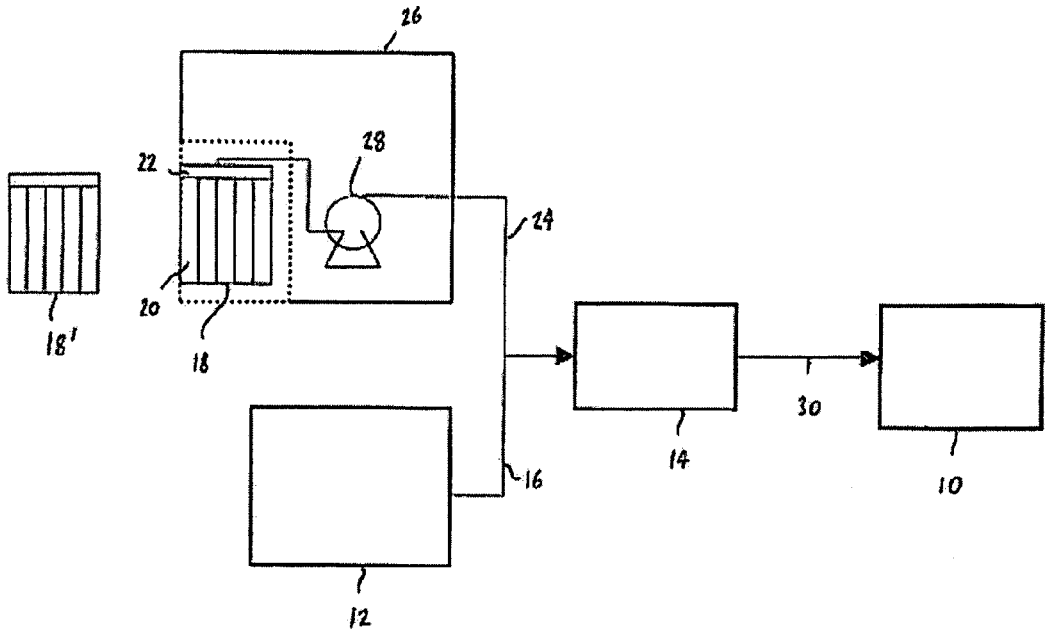
FIG. 1 is a schematic illustration of a first embodiment of an apparatus for supplying fluorine to a chamber of a process system.

FIG. 1 illustrates a first embodiment of an apparatus for supplying high purity fluorine to a process chamber 10 of a processing system. The process chamber 10 may be a chamber in which a deposition process is conducted for depositing a thin film on the surface of a substrate, for example, using a chemical vapour deposition (CVD) technique, a chamber in which etching of a substrate takes place, or a chamber in which any other processing technique is performed. Fluorine is supplied to the chamber 10 for cleaning the chamber 10 between process runs.

High purity fluorine, that is, a gas containing at least 99% fluorine, preferably at least 99.5% fluorine, is supplied to the chamber 10 from a on-site fluorine generator 12. Examples of a fluorine generator 12 suitable for use with the apparatus of FIG. 1 are the Generation-F™ fluorine generators available from BOC Edwards. Such generators typically generate fluorine at or around atmospheric pressure. As the chamber 10 is typically configured to receive fluorine at a pressure of around 15 to 20 psig, the fluorine generated by the fluorine generator 12 is conveyed to a fixed storage tank 14 via a first conduit system 16 extending between the fluorine generator 12 and the fixed storage tank 14 and including a compressor (not shown). Any compressor having proper surface passivation to resist fluorine attack would be suitable.

The fixed storage tank 14 has a volume of around 1000 liters, and typically stores gas at a pressure of around 20 psig in view of the compression of the gas conveyed between the fluorine generator 12 and the fixed storage tank 14.

As the fluorine generator 12 can deliver up to 16 kg of fluorine per day, in this second embodiment the fluorine generator 12 provides a primary source of fluorine to the fixed storage tank 14. In this embodiment, a transportable gas storage vessel 18 provides a secondary source of fluorine to the fixed storage tank 14. The storage vessel 18 is preferably in the form of a multi-cylinder pack (MCP) comprising a plurality of gas cylinders 20 connected to a common manifold 22 and each containing high purity fluorine, although any other suitable type of transportable gas storage vessel, such as a bulk transport vessel, may be used. The pressure of the fluorine within the MCP 18 is relatively low, preferably below 35 psig, most preferably below 25 psig. In the illustrated embodiment, the MCP 18 comprises fifteen, 49 liter gas cylinders, and each containing high purity fluorine at a pressure of around 25 psig. Other combinations of (i) the number of cylinders 20, (ii) the capacity of the cylinders 20, and (iii) the pressure of the fluorine within the cylinders 20 are, of course, possible.

The manifold 22 of the MCP 18 is connected to a second conduit system 24 for transferring fluorine from the MCP 18 to the fixed storage tank 14. For safety purposes, the MCP 18 is, during use, housed within a ventilated gas storage cabinet 26. A compressor 28 may be provided within the second conduit system 24 for selectively drawing fluorine from the MCP 18 as required and exhausting fluorine to the fixed storage tank 14 at a pressure roughly the same as that exhaust from the compressor provided within the first conduit system 16. As shown in FIG. 1, the compressor 28 may be located within the cabinet 26, or may alternatively be located proximate the fixed storage tank 14. Again, any compressor having proper surface passivation to resist fluorine attack would be suitable.

A third conduit system 30 is provided for conveying the high purity fluorine from the fixed storage tank 14 to the chamber 10. One or more valves (not shown) may be provided for selectively opening and closing the third conduit system 30 so that fluorine may be provided to the chamber 10 as required, for example, in between process runs, to clean the chamber 10.

The MCP 18 can thus provide a relatively cheap secondary fluorine source for selectively supplying fluorine to the fixed storage tank 14 in the event of failure of the fluorine generator 12. Sharing of the fixed storage tank 14 and third conduit system 30 between the primary and secondary fluorine sources also serves to reduce costs.

Furthermore, due to the relatively low pressure at which fluorine is stored—both within the MCP 18 and the fixed storage tank 14—the safety associated with the apparatus for supplying fluorine to the chamber 10 is much greater than that associated with systems where a high pressure fluorine source is used. Furthermore, as high purity fluorine is used throughout the apparatus, the rate at which the MCP 18 needs to be replaced with a fresh MCP 18' is lower than when a cylinder containing 20% $F_2$/80% $N_2$ gas mixture, albeit at a higher pressure, is used to supply fluorine to the chamber 10.

In addition, whilst the MCPs 18 may be filled remotely from a source of high purity fluorine and transported to the processing system, due to the presence of an on-site fluorine generator 12, exhausted MCPs 18 can instead be filled with fluorine generated by the fluorine generator 12, for example by selectively closing the first conduit system 16 and conveying the generated fluorine to the exhausted MCP. By avoiding the transportation of exhausted MCPs back to the remote source for re-filling and subsequent transportation back to the processing system, further cost savings and improved safety can be provided.

Figure 2:
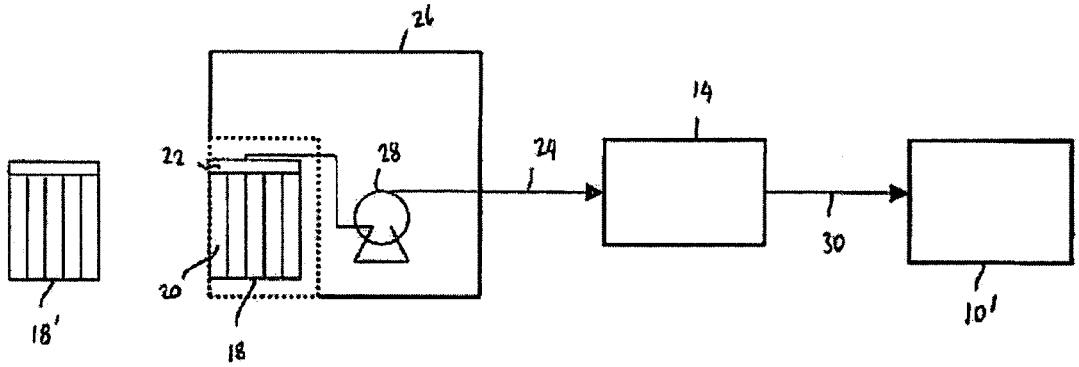
FIG. 2 is a schematic illustration of a second embodiment of an apparatus for supplying fluorine to a chamber of a process system.

As the MCPs 18 may be re-filled from a remote source of high purity fluorine and transported back to the processing system, a low cost version of the apparatus may be provided which does not include a fluorine generator 12 or associated conduit system 16. Such an apparatus is shown in FIG. 2. The incremental cost associated with subsequently installing a fluorine generator 12 following the installation of the apparatus shown in FIG. 2 would be relatively low, and would not involve any disruption in the supply of high purity fluorine to the chamber 10 from an MCP 18.

While the foregoing description and drawings represent the preferred embodiments of the present invention, it will be apparent to those skilled in the art that various changes and modifications may be made therein without departing from the true spirit and scope of the present invention.

The invention claimed is:

1. A method of delivering high purity fluorine to a processing system, the method comprising the steps of generating high purity fluorine using a fluorine generator located proximate the processing system, transferring fluorine from the fluorine generator to a fixed storage tank, providing a transportable gas storage vessel containing high purity fluorine at a pressure below 35 psig, selectively transferring fluorine from the transportable gas storage vessel to the fixed storage tank, and delivering fluorine to the processing system from the fixed storage tank.

2. The method according to claim 1 wherein the transportable gas storage vessel contains high purity fluorine at a pressure below 25 psig.

3. The method according to claim 1 wherein the transportable gas storage vessel comprises a plurality of gas cylinders.

4. The method according to claim 3 wherein the gas cylinders are connected to a common manifold from which fluorine is transferred to the fixed storage tank.

5. The method according to claim 1 wherein the high purity fluorine contains at least 99% fluorine.

6. The method according to claim 5 wherein the high purity fluorine contains at least 99.5% fluorine.

7. The method according to claim 1 wherein fluorine is transferred from the transportable gas storage vessel to the fixed storage tank using a compressor.

8. The method according to claim 1 wherein fluorine is stored in the fixed storage tank at a pressure in the range from 5 to 25 psig.

9. The method according to claim 1 wherein fluorine is delivered to a process chamber of the processing system.

10. The method according to claim 9 wherein the process chamber is a CVD process chamber.

11. The method according to claim 1 wherein fluorine is transferred from the fluorine generator to the fixed storage tank using a compressor.

12. The method according to claim 1 wherein the transportable gas storage vessel is filled at a site remote from the processing system.

13. The method according to claim 1 wherein the storage vessel is filled with fluorine generated by the fluorine generator.

14. A method of delivering high purity fluorine to a processing system, the method comprising the steps of generating high purity fluorine using a fluorine generator located proximate the processing system, transferring fluorine from the fluorine generator to a fixed storage tank, filling a transportable gas storage vessel with fluorine generated by the fluorine generator to a pressure below 35 psig, selectively transferring fluorine from the transportable gas storage vessel to the fixed storage tank, and delivering fluorine to the processing system from the fixed storage tank.

15. A method of delivering high purity fluorine to a processing system, the method comprising the steps of transporting to the processing system a transportable gas storage vessel containing high purity fluorine at a pressure below 35 psig, transferring fluorine from the transportable gas storage vessel to a fixed storage tank, and delivering fluorine to the processing system from the fixed storage tank.

16. The method according to claim 15 wherein the transportable gas storage vessel contains high purity fluorine at a pressure below 25 psig.

17. The method according to claim 15 wherein the transportable storage vessel comprises a plurality of gas cylinders.

18. The method according to claim 17 wherein the gas cylinders are connected to a common manifold from which fluorine is transferred to the fixed storage tank.

19. The method according to claim 15 wherein the transportable storage vessel is filled at a site remote from the processing system.

20. The method according to claim 15 wherein the high purity fluorine contains at least 99% fluorine.

21. The method according to claim 20 wherein the high purity fluorine contains at least 99.5% fluorine.

22. The method according to claim 15 wherein fluorine is transferred from the transportable storage vessel to the fixed storage tank using a compressor.

23. The method according to claim 15 wherein fluorine is stored in the fixed storage tank at a pressure in the range from 5 to 25 psig.

24. The method according to claim 15 wherein fluorine is delivered to a process chamber of the processing system.

25. The method according to claim 24 wherein the process chamber is a CVD process chamber.

26. The method according to claim 15 wherein high purity fluorine is also supplied to the fixed storage tank from a fluorine generator.

27. The method according to claim 26 wherein fluorine is transferred from the fluorine generator to the transportable storage tank using a compressor.

28. The method according to claim 26 wherein the transportable storage vessel is filled with fluorine generated by the fluorine generator.

29. Apparatus for delivering high purity fluorine to a processing system, the apparatus comprising a fluorine generator located proximate the processing system for generating high purity fluorine, a fixed storage tank, means from transferring fluorine from the fluorine generator to the fixed storage tank, a transportable gas storage vessel containing high purity fluorine at a pressure below 35 psig, means for selectively transferring fluorine from the storage vessel to the fixed storage tank, and means for delivering fluorine to the processing system from the fixed storage tank.

30. The apparatus according to claim 29 wherein the transportable gas storage vessel contains high purity fluorine at a pressure below 25 psig.

31. The apparatus according to claim 29 wherein the transportable gas storage vessel comprises a plurality of gas cylinders.

32. The apparatus according to claim 31 wherein the gas cylinders are connected to a common manifold from which fluorine is transferred to the fixed storage tank.

33. The apparatus according to claim 29 wherein the high purity fluorine contains at least 99% fluorine.

34. The apparatus according to claim 29 wherein the high purity fluorine contains at least 99.5% fluorine.

35. The apparatus according to claim 29 wherein the means for transferring fluorine from the transportable gas storage vessel to the fixed storage tank comprises a compressor.

36. The apparatus according to claim 35 wherein the compressor is located within a cabinet housing the transportable gas storage vessel.

37. The apparatus according to claim 29 wherein the fixed storage tank is arranged to store fluorine at a pressure in the range from 5 to 25 psig.

38. The apparatus according to claim 29 comprising a compressor for drawing fluorine from the fluorine generator and exhausting fluorine to the fixed storage tank.

39. Apparatus for delivering high purity fluorine to a processing system, the apparatus comprising a transportable gas storage vessel containing high purity fluorine at a pressure below 35 psig, a fixed storage tank, means for transferring fluorine from the storage vessel to the fixed storage tank, and means for delivering fluorine to the processing system from the fixed storage tank.

40. The apparatus according to claim 39 wherein the transportable gas storage vessel contains high purity fluorine at a pressure below 25 psig.

41. The apparatus according to claim 39 wherein the transportable gas storage vessel comprises a plurality of gas cylinders.

42. The apparatus according to claim 41 wherein the gas cylinders are connected to a common manifold from which fluorine is transferred to the fixed storage tank.

43. The apparatus according to claim 39 wherein the high purity fluorine contains at least 99% fluorine.

44. The apparatus according to claim 39 wherein the high purity fluorine contains at least 99.5% fluorine.

45. The apparatus according to claim 39 wherein the means for transferring fluorine from the transportable gas storage vessel to the fixed storage tank comprises a compressor.

46. The apparatus according to claim 45 wherein the compressor is located within a cabinet housing the transportable gas storage vessel.

47. The apparatus according to claim 39 wherein the fixed storage tank is arranged to store fluorine at a pressure in the range from 5 to 25 psig.

48. The apparatus according to claim 39 comprising a fluorine generator located proximate the processing system for supplying high purity fluorine to the fixed storage tank.

49. The apparatus according to claim 48 comprising a compressor for drawing fluorine from the fluorine generator and exhausting fluorine to the storage tank.

* * * * *